US011298603B2

(12) United States Patent
Wang et al.

(10) Patent No.: US 11,298,603 B2
(45) Date of Patent: Apr. 12, 2022

(54) TENNIS TRAINING DEVICE AND TENNIS TRAINING SYSTEM

(71) Applicant: SHENZHEN EASTSTAR ELECTRONIC TECHNOLOGY CO., LTD., Shenzhen (CN)

(72) Inventors: Yige Wang, Shenzhen (CN); Xuezhen Wang, Shenzhen (CN)

( * ) Notice: Subject to any disclaimer, the term of this patent is extended or adjusted under 35 U.S.C. 154(b) by 144 days.

(21) Appl. No.: 16/812,367

(22) Filed: Mar. 9, 2020

(65) Prior Publication Data

US 2021/0236905 A1 Aug. 5, 2021

Related U.S. Application Data

(63) Continuation of application No. PCT/CN2020/074510, filed on Feb. 7, 2020.

(30) Foreign Application Priority Data

Feb. 3, 2020 (CN) ..... 202010079190.6

(51) Int. Cl.
*A63B 69/38* (2006.01)

(52) U.S. Cl.
CPC ..... *A63B 69/38* (2013.01); *A63B 2225/09* (2013.01)

(58) Field of Classification Search
CPC ..... A63B 69/38
See application file for complete search history.

(56) References Cited

U.S. PATENT DOCUMENTS

| | | | | | |
|---|---|---|---|---|---|
| 3,989,246 | A * | 11/1976 | Brown | A63B 47/025 | 473/431 |
| 4,021,036 | A * | 5/1977 | Nelson | A63B 47/002 | 473/459 |
| 4,417,728 | A * | 11/1983 | Hay | A63B 69/0097 | 473/435 |
| D789,466 | S * | 6/2017 | Cho | D21/705 | |
| 10,245,495 | B2 | 4/2019 | Dagn | | |
| 2007/0087867 | A1* | 4/2007 | Morshed | A63B 47/002 | 473/459 |
| 2011/0124444 | A1* | 5/2011 | Uehling, III | A63B 69/38 | 473/459 |

(Continued)

FOREIGN PATENT DOCUMENTS

| | | | |
|---|---|---|---|
| CN | 109821214 | A | 5/2019 |
| CN | 208943410 | U | 6/2019 |
| CN | 110478880 | A | 11/2019 |

*Primary Examiner* — Raleigh W Chiu

(57) ABSTRACT

A tennis training device used for tennis training with a tennis trainer, including a batting component, a rebounding net component which can be separated, a controller, a microphone and an LED lamp which are connected with the controller. The batting component includes an adjustable bracket group and a batting cloth connected to the bracket group. An upper end of the batting cloth is provided with a ball receiving barrel and a ball guiding tube connected with the ball receiving barrel. Protecting nets are arranged on both sides of the batting cloth. The rebounding net component includes a supporting rod and a rebounding net plate movably arranged on the supporting rod. A tennis training system conducting training information interaction with the tennis trainer through the above tennis training device, which is connected with an application program on a mobile device.

10 Claims, 7 Drawing Sheets

(56) References Cited

U.S. PATENT DOCUMENTS

| | | | | |
|---|---|---|---|---|
| 2012/0283046 | A1* | 11/2012 | Yamanashi | A63B 69/0097<br>473/432 |
| 2016/0175682 | A1* | 6/2016 | Patton | A63B 69/38<br>473/431 |
| 2019/0358511 | A1 | 11/2019 | Scott | |
| 2020/0016469 | A1 | 1/2020 | Robertson | |
| 2021/0236905 | A1* | 8/2021 | Wang | A63B 69/38 |

* cited by examiner

TENNIS TRAINING DEVICE AND TENNIS TRAINING SYSTEM

CROSS-REFERENCE TO RELATED APPLICATIONS

This application is a continuation of International Patent Application No. PCT/CN2020/074510 with a filing date of Feb. 7, 2020, designating the United States, now pending, and further claims priority to Chinese Patent Application No. 202010079190.6 with a filing date of Feb. 3, 2020. The content of the aforementioned applications, including any intervening amendments thereto, are incorporated herein by reference.

TECHNICAL FIELD

The present invention relates to the technical field of sports training equipment, and particularly relates to a tennis training device and a tennis training system.

BACKGROUND OF THE PRESENT INVENTION

With the pursuit of health and the love for sports by people, sports such as table tennis, badminton and tennis are more and more popular. A table tennis training device, a badminton training device and a tennis training device also emerge. People can use the above training equipment to practice without coach or partner, so as to improve ball skills or exercise. However, the above sports devices are often bulky and complicated to install, which makes it difficult to carry and inconvenient to use.

In addition, traditional sports training equipment, such as the tennis training device, can only perform tennis training with people, but cannot provide users with information about the training process and training results, and thus cannot allow users to connect own training effects or improve training interests.

SUMMARY OF PRESENT INVENTION

The present invention provides a tennis training device and a tennis training system, so as to effectively solve the above problems. A batting component and a rebounding net component are separated, so as to facilitate transportation. Meanwhile, each bracket adopts lightweight material and a folding structure, which effectively reduces the weight of the tennis training device and saves the space.

The present invention is realized as follows: a tennis training device is used for tennis training with a tennis trainer and comprises a batting component and a rebounding net component which can be separated, wherein the batting component comprises an adjustable bracket group and a batting cloth connected to the bracket group; an upper end of the batting cloth is provided with a ball receiving barrel and a ball guiding tube connected with the ball receiving barrel; protecting nets are arranged on both sides of the batting cloth; the rebounding net component comprises a supporting rod and a rebounding net plate movably arranged on the supporting rod; the tennis training device further comprises a controller, and a microphone and an LED lamp which are connected with the controller; and when the tennis trainer is training, the microphone and the LED lamp provide sound and light to increase the training interest of the tennis trainer.

Further, the bracket group comprises a bottom contraction frame arranged in parallel to a horizontal plane, and a first vertical telescopic frame and a second vertical telescopic frame which are respectively arranged perpendicularly to the bottom contraction frame; and the first vertical telescopic frame and the second vertical telescopic frame are detachably connected with the bottom contraction frame.

Further, the bracket group comprises a bottom contraction frame arranged in parallel to a horizontal plane, and a first vertical telescopic frame and a second vertical telescopic frame which are respectively arranged perpendicularly to the bottom contraction frame; and the first vertical telescopic frame and the second vertical telescopic frame are connected with the bottom contraction frame in a folding mode.

Further, a plurality of telescopic nodes can be arranged on the first vertical telescopic frame and the second vertical telescopic frame; and the diameters of the first vertical telescopic frame and the second vertical telescopic frame are gradually decreased, so that the telescopic frame at each telescopic node can be accommodated in the telescopic node below the telescopic frame.

Further, the first vertical telescopic frame comprises a first telescopic node; the first vertical telescopic frame is divided into a first segment and a second segment by the first telescopic node; and the diameter of the second segment is smaller than the diameter of the first segment.

Further, the second vertical telescopic frame comprises a first telescopic node and a second telescopic node; the second vertical telescopic frame is divided into a first segment, a second segment and a third segment by the first telescopic node and the second telescopic node; the diameter of the third segment is smaller than the diameter of the second segment; and the diameter of the second segment is smaller than the diameter of the first segment.

Further, the bracket group further comprises an installing bracket for connecting the other ends of the first vertical telescopic frame and the second vertical telescopic frame; the batting cloth is arranged on the installing bracket; and the installing bracket is rotatably connected with end parts of the first vertical telescopic frame and the second vertical telescopic frame.

Further, the batting cloth is a batting cloth with an LED light emitting function; and when a tennis ball returns to the batting cloth, the position in which the tennis ball hits the batting cloth shines to inform the tennis trainer of the hitting position of the tennis ball.

Further, the tennis training device comprises a controller and a display screen; the display screen is arranged on the ball receiving barrel and connected to the controller; the tennis training device further comprises a microphone and a camera which are connected with the controller; and the camera is used to record a batting route, a batting mode and a batting position of the tennis trainer.

The present invention also provides a tennis training system which conducts training information interaction with the tennis trainer through the above tennis training device, wherein the controller collects motion information through a sensor on the tennis training device and transmits the motion information to a mobile device; application software is installed on the mobile device; the application software comprises a holographic image module, a report evaluation module and a training mode selection module; the holographic image module is used to display the whole-process training actions of the tennis trainer; the report evaluation module is used to query the training information; and the training mode selection module is used to add a tennis training mode.

The batting component and the rebounding net component of the tennis training device involved in the present invention are separated, so as to facilitate transportation. Secondly, the bracket group on the batting component selects the lightweight material and is designed into the folding structure, which not only integrally reduces the weight, but also reduces the space. The batting cloth is designed by LED light emitting cloth, which can feed back the batting position of the tennis trainer in time. Meanwhile, the tennis training device of the present invention also comprises various electronic devices, such as a display screen, a camera, a microphone, and the like, so as to record and output the motion information of the tennis trainer in time and achieve the goal of recording and reminding the trainer. The tennis training system of the present invention can analyze the motion information of tennis trainers in real time and can feed back all kinds of evaluation information, so that the tennis training device can well interact with the trainer through the application software, thereby increasing the interest of the tennis trainer during training. The tennis training device has the attributes of amusement equipment, is connected with an application program on the mobile device and expands the entertainment function of the tennis training device.

DESCRIPTION OF THE DRAWINGS

To describe the technical solutions of the embodiments of the present invention more clearly, the drawings to be used in the embodiments will be briefly introduced below. It should be understood that the following drawings show only some embodiments of the present invention and thus should not be construed as a limitation to the scope. For those ordinary skilled in the art, other related drawings can also be obtained according to these drawings without contributing creative labor.

DETAILED DESCRIPTION OF PREFERRED EMBODIMENTS

Figure 1:
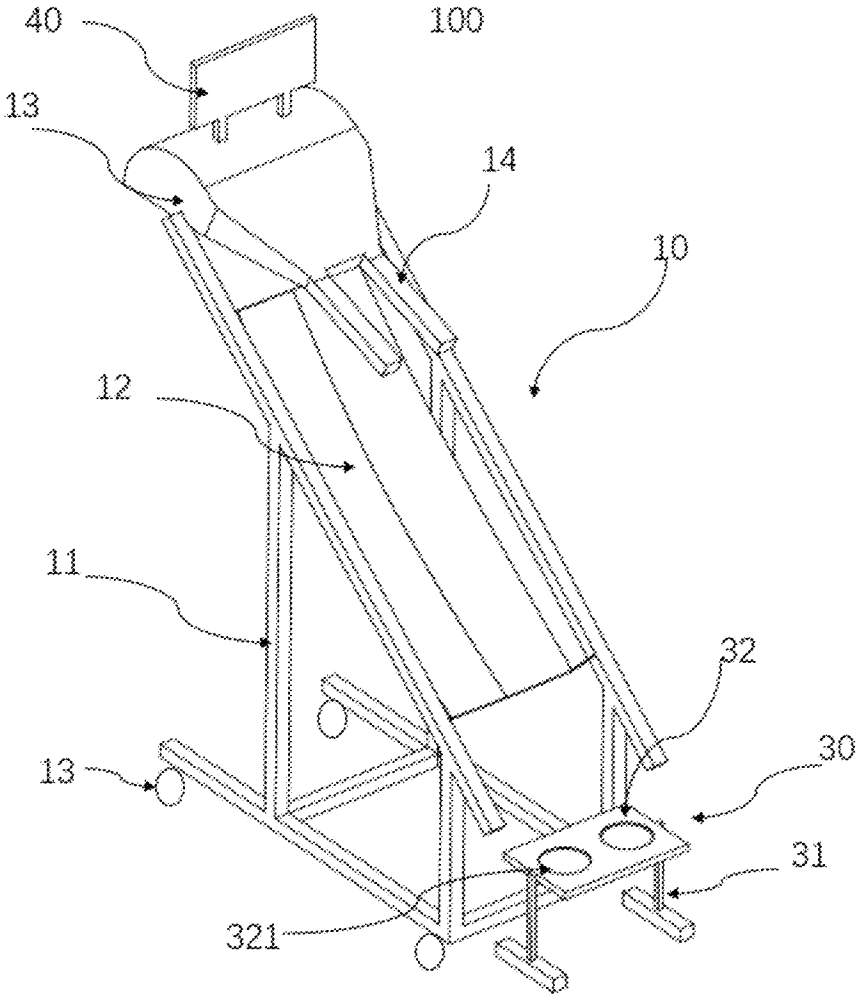
FIG. 1 is an assembly schematic diagram of a tennis training device of the present invention.

To make the purposes, technical solutions and advantages of the embodiments of the present invention clearer, the technical solutions in the embodiments of the present invention will be clearly and completely described below with reference to the drawings in the embodiments of the present invention. Apparently, the described embodiments are part of the embodiments of the present invention, not all of the embodiments. Based on the embodiments in the present invention, all other embodiments obtained by those ordinary skilled in the art without contributing creative labor shall belong to the protection scope of the present invention. Therefore, the following detailed description of the embodiments of the present invention provided in the drawings is not intended to limit the protection scope of the present invention, but merely to show selected embodiments of the present invention. Based on the embodiments in the present invention, all other embodiments obtained by those ordinary skilled in the art without contributing creative labor shall belong to the protection scope of the present invention.

The device and the method disclosed by the present invention can be realized in other ways. For example, the device embodiments described above are merely schematic. For example, the division of the units is only a logical functional division, and may be an additional division manner in actual realization. For example, multiple units or components can be combined or integrated into another system, or some features can be ignored or not executed. In addition, the displayed or discussed mutual coupling or direct coupling or communication connection may be indirect coupling or communication connection through some interfaces, devices or units, and may be electrical, mechanical or other forms.

The present invention provides a tennis training device which is mainly applied to tennis training with a tennis trainer and can save, analyze and feed back training process and training data of the tennis trainer. Specifically, by referring to FIG. 1, the tennis training device 100 comprises a batting component 10 and a rebounding net component 30 which are separated. Generally, the batting component and the rebounding net component of the tennis training device form an integral design structure. In this way, the occupation space of the entire tennis training device is large. In the present invention, the batting component 10 and the rebounding net component 30 are designed into separated structures. Thus, the batting component 10 and the rebounding net component 30 can be separately stored in difference places, and the batting component 10 and the rebounding net component 30 can be respectively placed in two small spaces, thereby effectively using the spaces.

Figure 2:
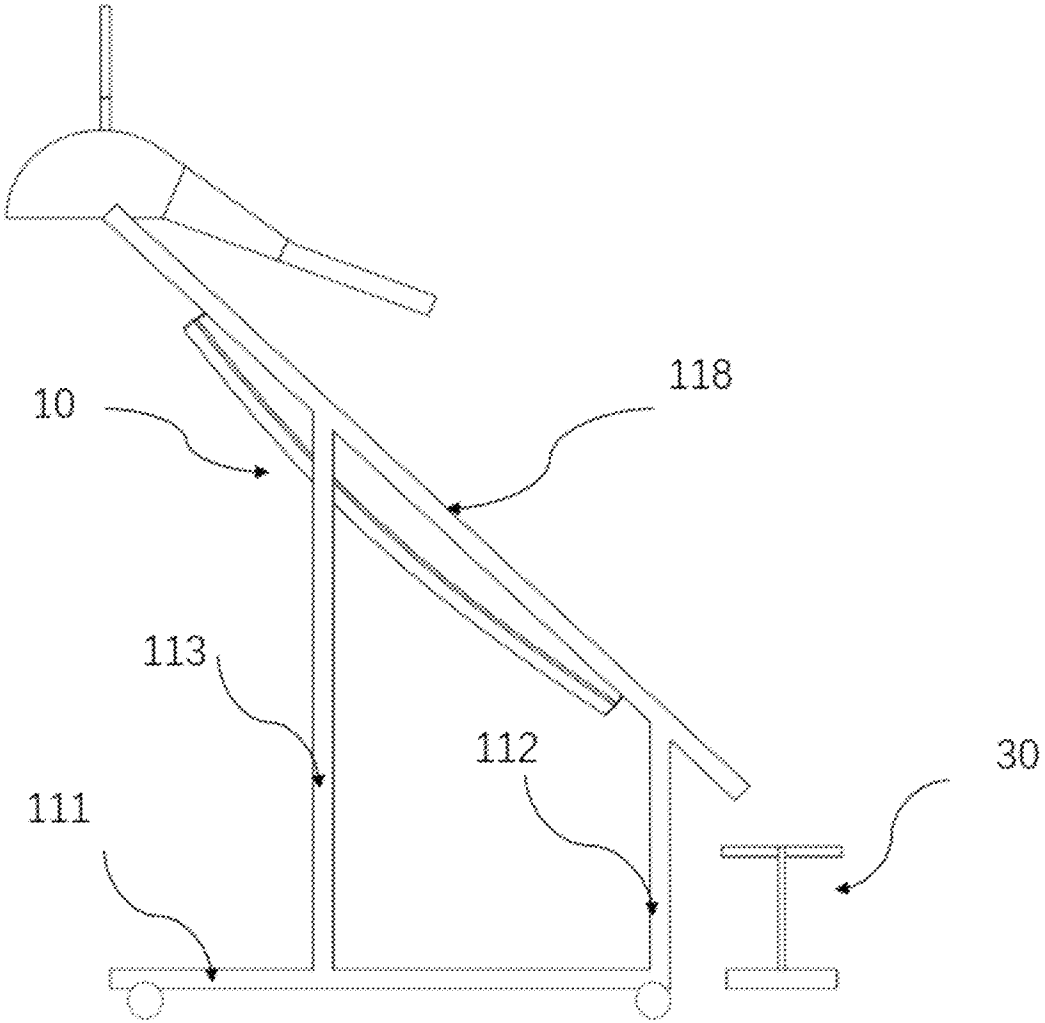
FIG. 2 is a side schematic diagram of a tennis training device shown in FIG. 1.
Figure 3:
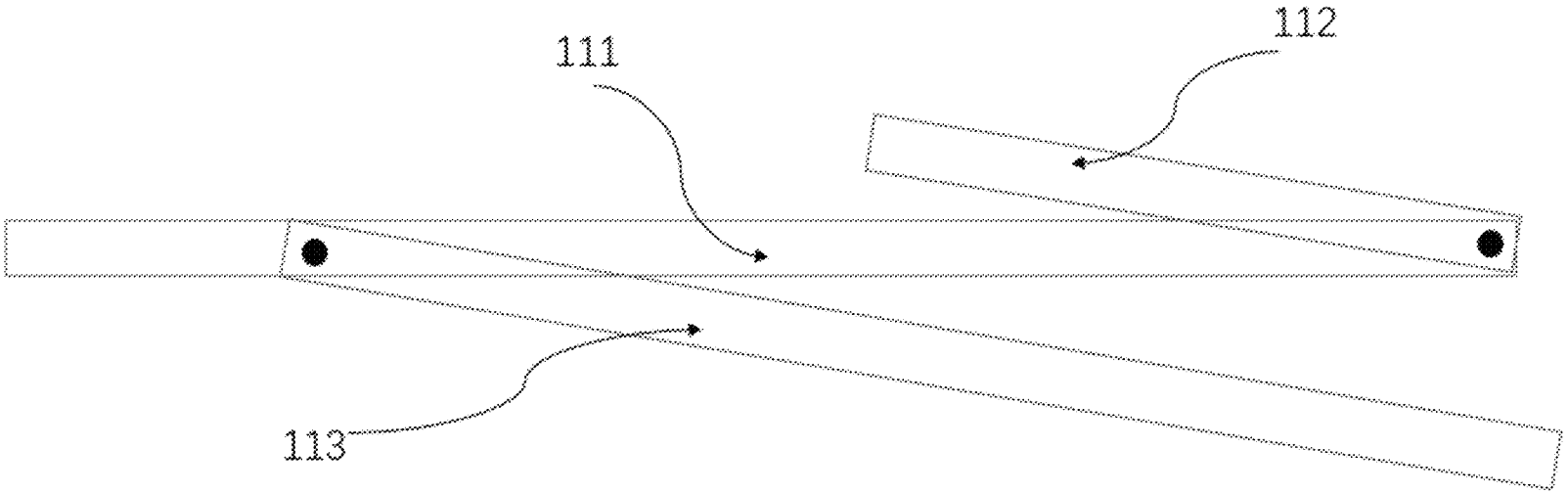
FIG. 3 is a schematic diagram of a folding state of a bracket component shown in FIG. 1.

By referring to FIG. 2, the batting component 10 comprises an adjustable bracket group 11, a batting cloth 12 connected to the bracket group 11, and a belt pulley group 13 connected to the lower part of the bracket group 11, wherein the bracket group 11 comprises a bottom contraction frame 111 arranged in parallel to a horizontal plane, and a first vertical telescopic frame 112 and a second vertical telescopic frame 113 which are respectively arranged perpendicularly to the bottom contraction frame 111. The first vertical telescopic frame 112 and the second vertical telescopic frame 113 can be detachably connected with the bottom contraction frame 111 through detachable structures such as screws and buckles, or the first vertical telescopic frame 112 and the second vertical telescopic frame 113 can be connected with the bottom contraction frame 111 in a folding mode through structures such as rotating shafts and hinges. By referring to FIG. 3, FIG. 3 is a schematic diagram of a folding state of the bottom contraction frame 111, the first vertical telescopic frame 112 and the second vertical telescopic frame 113.

Figure 4:
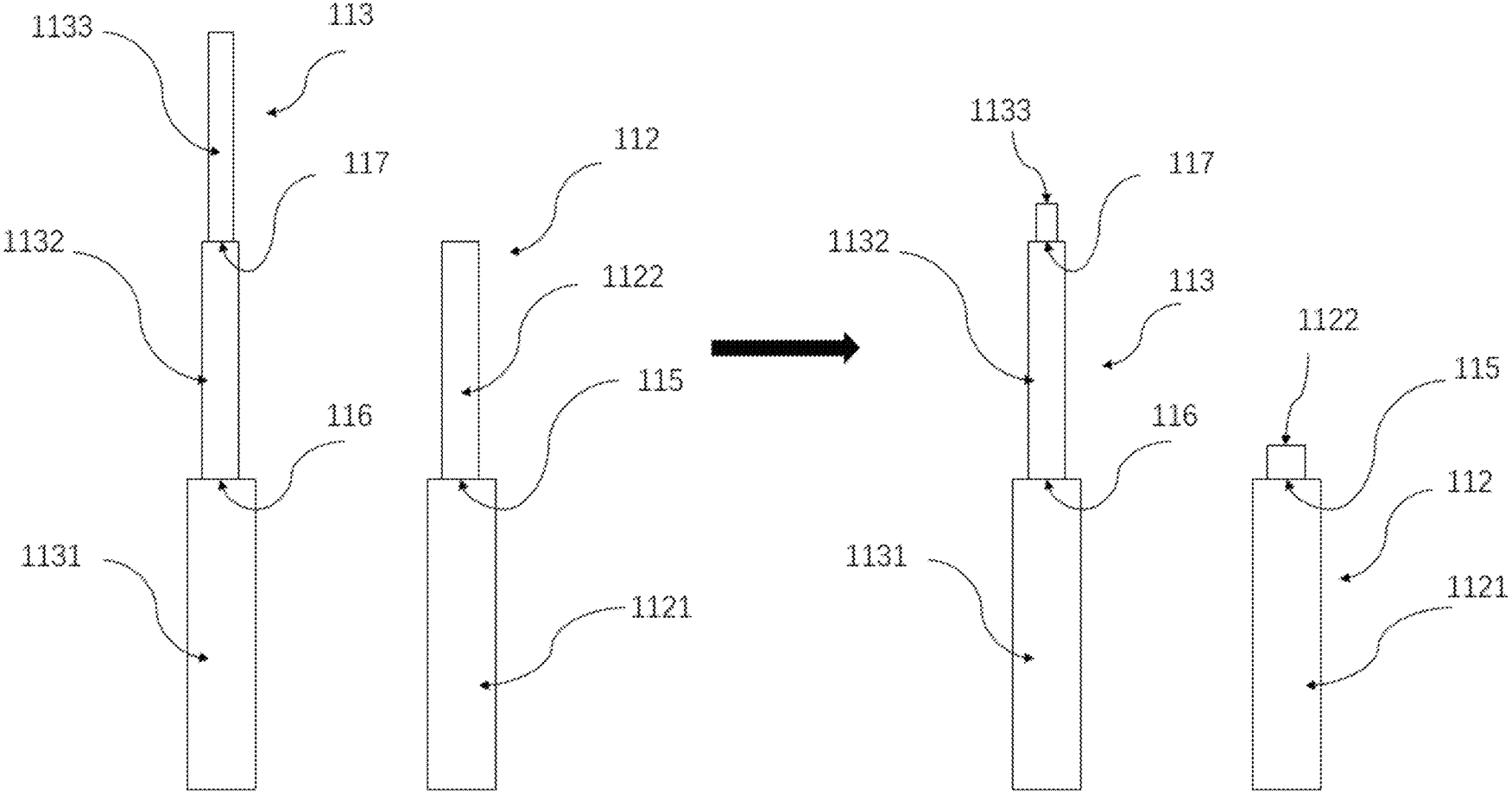
FIG. 4 is a telescopic schematic diagram of a bracket component shown in FIG. 1.

By referring to FIG. 4, a plurality of telescopic nodes 114 can be arranged on the first vertical telescopic frame 112 and the second vertical telescopic frame 113; and the diameters of the first vertical telescopic frame 112 and the second vertical telescopic frame 113 are gradually decreased, so that the telescopic frame at each telescopic node 114 can be accommodated in the telescopic node below the telescopic frame. For example, the first vertical telescopic frame 112 comprises a first telescopic node 115; the first vertical telescopic frame 112 is divided into a first segment 1121 and a second segment 1122 by the first telescopic node 115; and the diameter of the second segment 1122 is smaller than the diameter of the first segment 1121. The second vertical telescopic frame 113 comprises a first telescopic node 116 and a second telescopic node 117. The second vertical telescopic frame 113 is divided into a first segment 1131, a second segment 1132 and a third segment 1133 by the first telescopic node 116 and the second telescopic node 117; the diameter of the third segment 1133 is smaller than the diameter of the second segment 1132; and the diameter of the second segment 1132 is smaller than the diameter of the first segment 1131. In the present invention, the first vertical telescopic frame 112 and the second vertical telescopic frame 113 are designed into a plurality of telescopic nodes, which has two obvious effects. Firstly, for tennis trainers of different heights or age stages, the overall height of the tennis training device can be adjusted through the plurality of telescopic nodes designed by the first vertical telescopic frame 112 and the second vertical telescopic frame 113. For example, when the tennis trainer is a high adult, the first vertical telescopic frame 112 and the second vertical telescopic frame 113 can be vertically pulled and fixed at each telescopic node; and when the tennis trainer is a young child, the first segment 1121 of the first vertical telescopic frame 112 and the first segment 1131 and the second segment 1132 of the second vertical telescopic frame 113 can be pulled, so as to reduce the heights of the entire first vertical telescopic frame 112 and the second vertical telescopic frame 113 to adapt to the height of the child. Of course, a plurality of telescopic nodes can also be arranged for the first vertical telescopic frame 112 and the second vertical telescopic frame 113, which is not limited by the present invention, and the spacing between the first vertical telescopic frame 112 and the second vertical telescopic frame 113 can also be adjusted, to adapt to the need of the tennis trainer, which is not specifically listed in the present invention. Secondly, when training is needed, the second segment 1122 is extracted from the first segment 1121 and locked at the first telescopic node 115; and when training is not needed, the second segment 1122 can be accommodated in the first segment 1121, so as to reduce the occupation spaces of each of the first vertical telescopic frame 112 and the second vertical telescopic frame 113.

The bracket group 11 further comprises an installing bracket 118 for connecting the other ends of the first vertical telescopic frame 112 and the second vertical telescopic frame 113; the installing bracket 118 is arranged obliquely; the batting cloth 12 is arranged on the installing bracket 118; and the installing bracket 118 is rotatably connected with end parts of the first vertical telescopic frame 112 and the second vertical telescopic frame 113, i.e., an angle between the batting cloth 12 and the bracket group 11 can be adjusted, to match with different batting angles. Meanwhile, the batting cloth 12 in the present embodiment is a batting cloth with an LED light emitting function. When a tennis ball returns to the batting cloth 12, the position in which the tennis ball hits the batting cloth 12 shines to inform the tennis trainer of the hitting position of the tennis ball, so that the tennis trainer knows the own batting result in time in order to adjust the batting actions. A counting sensor is also arranged on the batting cloth 12. When the tennis trainer bats the ball to fall on the batting cloth 12, the counting sensor records the batting number for display on a display screen and the like, so as to remind the trainer of the information about the batting number.

In the present embodiment, a belt pulley group 13 comprises four belt pulleys; the four belt pulleys are respectively arranged at four end points of the bottom contraction frame 111; and the entire batting component 10 can be pushed to move by the belt pulley group 13 so that the batting component 10 can move conveniently.

The top end of the installing bracket 118 is provided with a ball receiving barrel 16 and a ball guiding tube 14 connected with the ball receiving barrel 16. The tennis ball falls on the rebounding net component 30 after being served through the ball guiding tube 14. After the tennis trainer bats the tennis ball, the tennis ball is batted on the batting cloth 12 and returns into the ball receiving barrel 16. The ball receiving barrel 16 is communicated with the ball guiding tube 14. The returned tennis ball is outputted from the ball guiding tube 14 again, and the training is repeatedly performed in this way.

Figure 5:
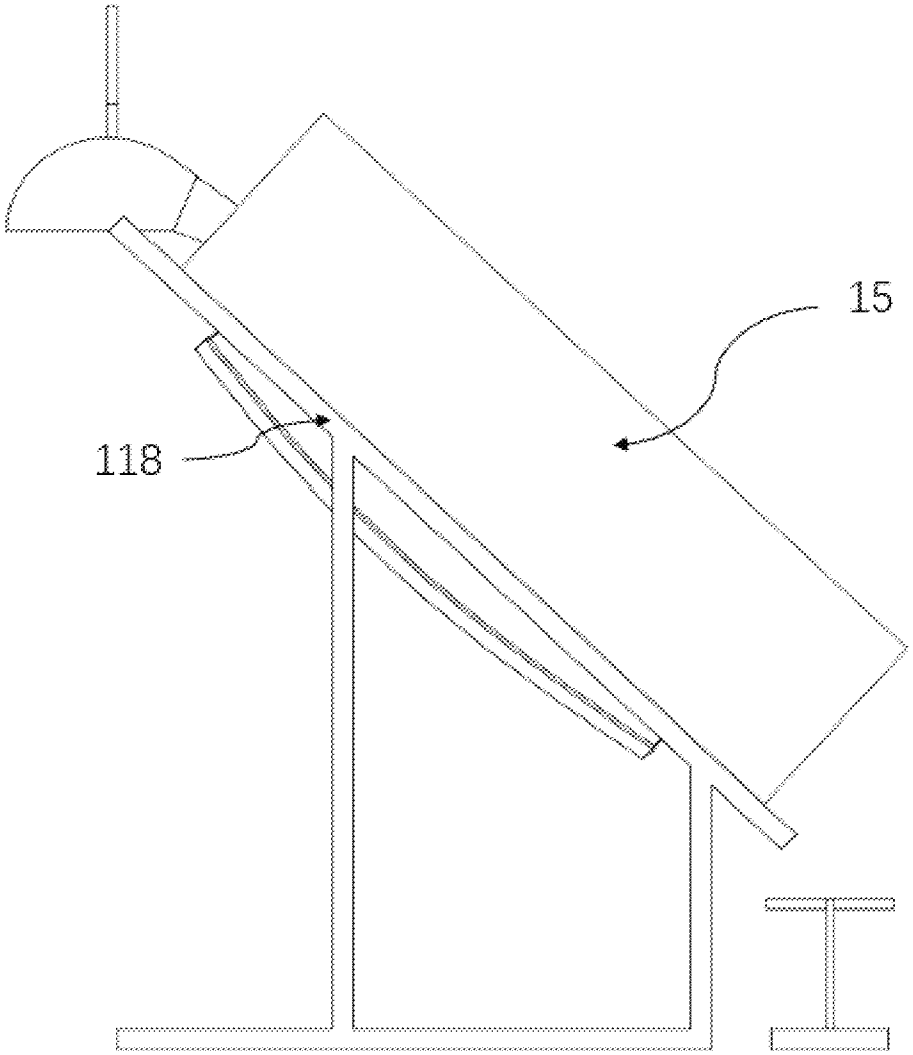
FIG. 5 is a schematic diagram of a tennis training device provided with protecting nets shown in FIG. 2.

By referring to FIG. 5, the batting component 10 also comprises protecting nets 15; the protecting nets 15 are installed on the installing bracket 118 and are arranged approximately at a certain angle with the batting cloth 12. The angle is greater than 90 degrees and less than 180 degrees. The main effect of increasing the protecting nets 15 is to effectively ensure that the tennis ball does not fly around and protect the safety of surrounding people.

By referring to FIG. 1, the rebounding net component 30 comprises an I-shaped supporting rod 31 and a rebounding net plate 32 arranged on the supporting rod 31. The rebounding net plate 32 is movably arranged on the supporting rod 31, so that a height distance of the tennis ball is controllable. A bouncing pedaling net 321 is arranged on the rebounding net plate 32. The rebounding net plate 32 can be positioned on the supporting rod 31 at any angle so as to adjust the angle between the rebounding net plate 32 and the batting cloth 12, thereby adapting to the training requirements of the tennis trainer.

The bracket group 11 of the batting component 10, the ball receiving barrel 16 and the ball guiding tube 14 connected with the ball receiving barrel 16 in the present invention are made of aviation aluminum material. Similarly, the I-shaped supporting rod 31 and the rebounding net plate 32 arranged on the supporting rod 31 included in the rebounding net component 30 are also made of aviation aluminum material. The entire weight is light.

Figure 6:
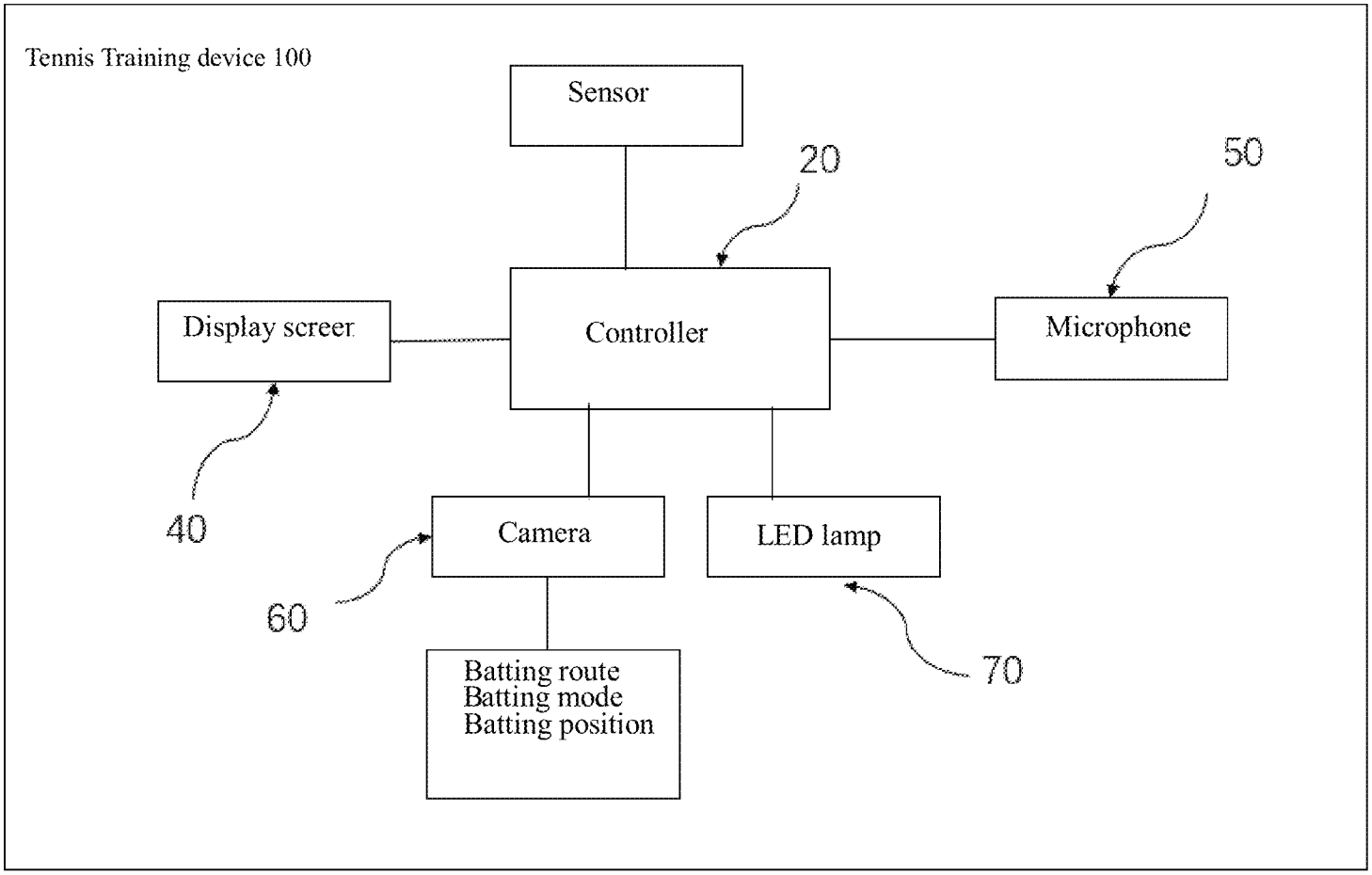
FIG. 6 is an electrical connection diagram of a tennis training device shown in FIG. 1.

By referring to FIG. 6, the tennis training device 100 of the present invention also comprises a controller 20 and a display screen 40 connected with the controller 20; the display screen 40 is arranged on the ball receiving barrel 16 of the batting component 10; and the display screen 40 can display the motion time, the batting number and other information of the tennis trainer.

The tennis training device 100 of the present invention also comprises a microphone 50 connected with the controller 20. The microphone 50 is installed on an end of the installing bracket 118 near the ground, and can remind the tennis trainer to switch the batting mode in time. For example, after the tennis trainer practices forehand for a period of time, the controller 20 calculates through various sensors that the tennis trainer reaches the training time and training times of forehand. At this time, the microphone 50 is controlled to remind the trainer to switch to drive a ball or other training modes, thereby reminding the trainer in time, so as to prevent the trainer from forgetting during the training.

The tennis training device 100 further comprises a plurality of LED lamps 70. The plurality of LED lamps 70 are installed on the installing bracket 118 and connected with the controller 20, or installed in other positions. The microphone 50 can play game sound stored in the controller 20.

The LED lamps 70 are matched with the music played by the microphone 50 to flash, so as to match with the tennis trainer to conduct funny practice.

The tennis training device 100 also comprises a camera 60 connected with the controller 20. The camera 60 can be installed in a visible hole of the ball tube, and can also be installed in other appropriate positions. The camera 60 can constantly shoot a batting trajectory and the batting action of the tennis trainer, and store the information in the controller 20. The camera 60 can shoot the batting route of the tennis trainer, which for example, can be a straight line or an oblique line, can also shoot the batting mode of the tennis trainer, such as slice, topspin or underspin, and can also shoot the batting position of the tennis trainer, such as opened or closed and transmit the above image information to the controller 20.

Figure 7:
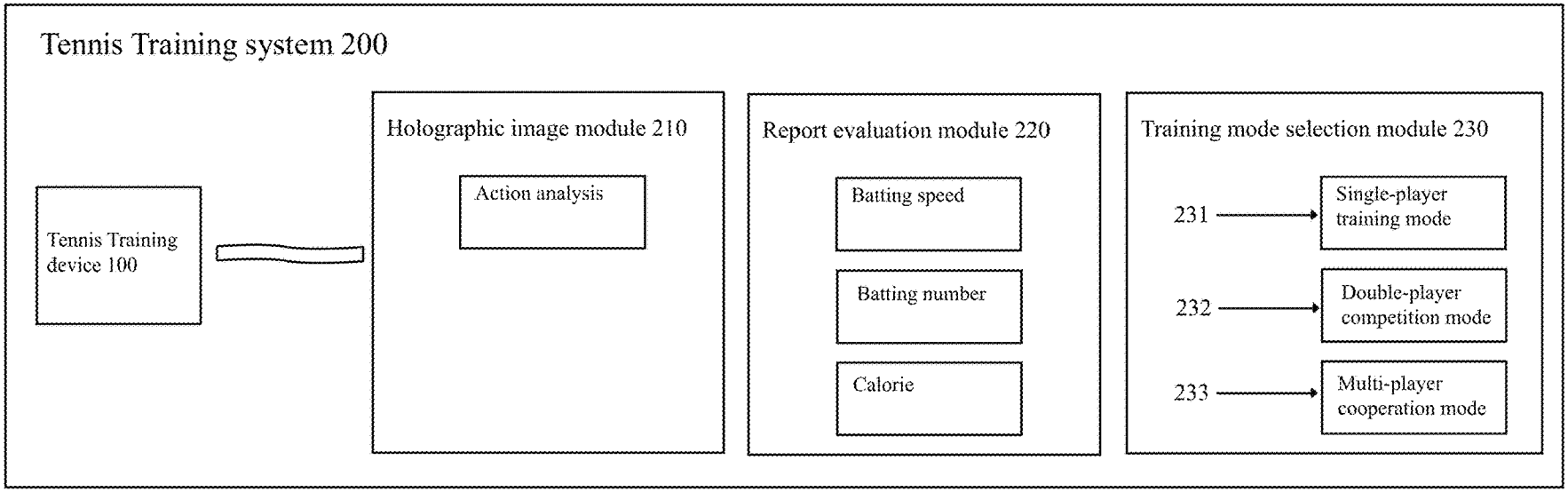
FIG. 7 is a block diagram of a tennis training system provided by the present invention in FIG. 1.

By referring to FIG. 7, the present invention also provides a tennis training system 200 which comprises the tennis training device 100. The tennis training system 200 comprises application software installed on the mobile device of the tennis trainer. The application software comprises a holographic image module 210, a report evaluation module 220 and a training mode selection module 230, wherein the mobile device is in wireless connection with the controller 20 on the tennis training device 100 through Bluetooth and the like. The controller 20 transmits the information collected from the sensors on the tennis training device 100 to the application software of the mobile device. The application software obtains comprehensive evaluation information of the tennis trainer by analyzing the information such as images, batting time and batting number. After the training, the tennis trainer can view own batting process through the holographic image module 210 of the application software, and find wrong batting actions through motion analysis. The tennis trainer can also view own batting route, batting mode, batting position, batting speed, batting number, training time, consumed calories and other information through the report evaluation module 220 to fully understand own physical fitness information, motion information, etc. during the entire training process, so as to achieve comprehensive training and visual training.

In the practice process, the tennis trainers can also select training modules of different interests through the training mode selection module 230. The training mode selection module 230 may include a single-player training mode 231, a double-player competition mode 232 and a multi-player cooperation mode 233. The tennis trainer selects the single-player training mode 231 through APP on the mobile device. When the trainer selects the single-player training mode 231, the mobile device controls the microphone 50 and the LED lamps 70 of the tennis training device 100 through the APP to play the music and light in cooperation with the single-player training mode 231, thereby improving the training interest of the tennis trainers in single-player training mode 231. The training information of the tennis trainer in the single-player training mode 231 is recorded and uploaded to a network. The tennis training device 100 can also comprise a related supporting game-assisted virtual device. The game-assisted virtual device may be connected with the APP to increase the interest of the tennis trainer during training. In this way, the training information of the trainer, such as skill value, obtained level and accumulated experience value, can be uploaded to the network, compared and contrasted with those of other tennis training players. The trainer can view own training rank or/and competition rank through a ranking list. Various training modes of the APP are matched with the sound and light effects on the tennis training device, thereby greatly improving the training interest of tennis trainer. The tennis training device 100 has the attributes of amusement equipment, is connected with the application program on the mobile device and expands the entertainment function of the tennis training device 100.

The batting component 10 and the rebounding net component 30 of the tennis training device 100 involved in the present invention are separated, so as to facilitate transportation. Secondly, the bracket group 11 on the batting component 10 selects the lightweight material and is designed into the folding structure, which not only integrally reduces the weight, but also reduces the space. The batting cloth 12 is designed by LED light emitting cloth, which can feed back the batting position of the tennis trainer in time. Meanwhile, the tennis training device 100 of the present invention also comprises various electronic devices, such as a display screen, a camera, a microphone, and the like, so as to record and output the motion information of the tennis trainer in time and achieve the goal of recording and reminding the trainer. The tennis training system 200 of the present invention can analyze the motion information of tennis trainers in real time and can feed back all kinds of evaluation information, so that the tennis training device 100 can well interact with the trainer through the application software, thereby increasing the training interest of the tennis trainer. The tennis training device 100 has the attributes of the amusement equipment, is connected with the application program on the mobile device and expands the entertainment function of the tennis training device 100.

The above only describes preferred embodiments of the present invention and is not intended to limit the present invention. For those skilled in the art, various variations and changes can be made to the present invention. Any modification, equivalent replacement, improvement, etc. made within the spirit and the principle of the present invention shall be included within the protection scope of the present invention.

What is claimed is:

1. A tennis training device used for tennis training with a tennis trainer, comprising a batting component and a rebounding net component which can be separated, wherein the batting component comprises an adjustable bracket group; the bracket group comprises an installing bracket; the installing bracket is connected with a batting cloth; an upper end of the batting cloth is provided with a ball receiving barrel and a ball guiding tube connected with the ball receiving barrel; protecting nets are arranged on both sides of the batting cloth; the rebounding net component comprises a supporting rod and a rebounding net plate movably arranged on the supporting rod; the tennis training device further comprises a controller, and a microphone and an LED lamp which are connected with the controller; and when the tennis trainer is training, the microphone and the LED lamp provide sound and light to increase the training interest of the tennis trainer.

2. The tennis training device according to claim 1, wherein the bracket group comprises a bottom contraction frame arranged in parallel to a horizontal plane, and a first vertical telescopic frame and a second vertical telescopic frame which are respectively arranged perpendicularly to the bottom contraction frame; and the first vertical telescopic frame and the second vertical telescopic frame are detachably connected with the bottom contraction frame.

3. The tennis training device according to claim 2, wherein a plurality of telescopic nodes can be arranged on the first vertical telescopic frame and the second vertical telescopic frame; and the diameters of the first vertical telescopic frame and the second vertical telescopic frame are gradually decreased, so that the telescopic frame at each telescopic node can be accommodated in the telescopic node below the telescopic frame.

4. The tennis training device according to claim 3, wherein the first vertical telescopic frame comprises a first telescopic node; the first vertical telescopic frame is divided into a first segment and a second segment by the first telescopic node; and the diameter of the second segment is smaller than the diameter of the first segment.

5. The tennis training device according to claim 3, wherein the second vertical telescopic frame comprises a first telescopic node and a second telescopic node; the second vertical telescopic frame is divided into a first segment, a second segment and a third segment by the first telescopic node and the second telescopic node; the diameter of the third segment is smaller than the diameter of the second segment; and the diameter of the second segment is smaller than the diameter of the first segment.

6. The tennis training device according to claim 3, wherein the bracket group further comprises an installing bracket for connecting the other ends of the first vertical telescopic frame and the second vertical telescopic frame; the batting cloth is arranged on the installing bracket; and the installing bracket is rotatably connected with end parts of the first vertical telescopic frame and the second vertical telescopic frame.

7. The tennis training device according to claim 1, wherein the bracket group comprises a bottom contraction frame arranged in parallel to a horizontal plane, and a first vertical telescopic frame and a second vertical telescopic frame which are respectively arranged perpendicularly to the bottom contraction frame; and the first vertical telescopic frame and the second vertical telescopic frame are connected with the bottom contraction frame in a folding mode.

8. The tennis training device according to claim 1, wherein the batting cloth is a batting cloth with an LED light emitting function; and when a tennis ball returns to the batting cloth, the position in which the tennis ball hits the batting cloth shines to inform the tennis trainer of the hitting position of the tennis ball.

9. The tennis training device according to claim 1, wherein the tennis training device comprises a controller and a display screen; the display screen is arranged on the ball receiving barrel and connected to the controller; the tennis training device further comprises a camera connected with the controller; and the camera is used to record a batting route, a batting mode and a batting position of the tennis trainer.

10. A tennis training system which conducts training information interaction with the tennis trainer through the tennis training device of claim 1, wherein the controller collects motion information through a sensor on the tennis training device and transmits the motion information to a mobile device; application software is installed on the mobile device; the application software comprises a holographic image module, a report evaluation module and a training mode selection module; the holographic image module is used to display the whole-process training actions of the tennis trainer; the report evaluation module is used to query the training information; and the training mode selection module is used to add a tennis training mode.

* * * * *